US010630017B2

(12) United States Patent
Zhou

(10) Patent No.: US 10,630,017 B2
(45) Date of Patent: Apr. 21, 2020

(54) INSULATING SHEATH OF PLUG

(71) Applicant: ARGANGLE TECHNOLOGY CO. LTD, Chengdu, Sichuan (CN)

(72) Inventor: Gang Zhou, Sichuan (CN)

(73) Assignee: ARGANGLE TECHNOLOGY CO. LTD., Chengdu, Sichuan (CN)

( * ) Notice: Subject to any disclaimer, the term of this patent is extended or adjusted under 35 U.S.C. 154(b) by 0 days.

(21) Appl. No.: 16/073,782

(22) PCT Filed: Mar. 21, 2016

(86) PCT No.: PCT/CN2016/076832

§ 371 (c)(1),
(2) Date: Jul. 28, 2018

(87) PCT Pub. No.: WO2017/128503

PCT Pub. Date: Aug. 3, 2017

(65) Prior Publication Data

US 2019/0036265 A1 Jan. 31, 2019

(30) Foreign Application Priority Data

Jan. 29, 2016 (CN) ..... 2016 2 0090192 U

(51) Int. Cl.
*H01R 13/44* (2006.01)
*H01R 103/00* (2006.01)
(Continued)

(52) U.S. Cl.
CPC ..... *H01R 13/44* (2013.01); *H01R 13/5213* (2013.01); *H01R 24/30* (2013.01); *H01R 2103/00* (2013.01)

(58) Field of Classification Search
CPC ..... H01R 13/44
See application file for complete search history.

(56) References Cited

U.S. PATENT DOCUMENTS 3,784,957 A * 1/1974 Bailey ..... H01L 23/4828 439/86
6,106,327 A * 8/2000 Bungo ..... G01L 23/22 439/125
(Continued)

FOREIGN PATENT DOCUMENTS

CN 2337689 Y 9/1999
CN 201051571 Y 4/2008
(Continued)

*Primary Examiner* — Tho D Ta
(74) *Attorney, Agent, or Firm* — Novick, Kim & Lee, PLLC; Allen Xue

(57) ABSTRACT

An insulating sheath of a plug has a sheet-like sheath main body (1), a contact pin sheath (2) and a contact pin hole (3). The contact pin sheath protrudes from the sheath main body, the contact pin hole is a through-hole allowing the contact pin sheath to communicate with the sheath main body, and the contact pin hole is used for being sheathed on a contact pin of the plug. The insulating sheath can adhere the sheath main body to an insulation part of the plug, and can protect the contact pin at the same time, preventing short circuit by water leakage or electric leakage between contact pins, and also preventing an electric shock caused by a finger touching the contact pin without affecting normal plugging-in and unplugging of the plug.

15 Claims, 10 Drawing Sheets

(51) Int. Cl.
*H01R 24/30* (2011.01)
*H01R 13/52* (2006.01)

(56) References Cited

U.S. PATENT DOCUMENTS

| | | | | |
|---|---|---|---|---|
| 7,775,814 | B1 * | 8/2010 | Bhutani | H01R 13/447 439/146 |
| 8,770,994 | B1 * | 7/2014 | Fagan | H01R 13/44 439/141 |
| 8,961,202 | B2 * | 2/2015 | Busson, Jr. | H01R 13/44 439/131 |
| 2005/0106909 | A1 * | 5/2005 | Dickie | H01R 13/44 439/134 |

FOREIGN PATENT DOCUMENTS

| | | | |
|---|---|---|---|
| CN | 102361186 | A | 2/2012 |
| GB | 2239743 | A | 7/1991 |

* cited by examiner

INSULATING SHEATH OF PLUG

TECHNICAL FIELD

The utility model relates to an insulating device for a plug, in particular to an insulating sheath of a plug, and belongs to the technical field of connectors.

BACKGROUND OF THE UTILITY MODEL

With the increasing diversification of household appliances, various electrical appliances have been inseparable from power supplies. The connection of plugs and sockets for power supply has the advantages of good usability, low cost and good popularization. As a result, plugs and sockets become one of the most common electrical components in people's production and life. An existing plug of general international standard (GB) is composed of a plastic part and two or three metal inserts. The plastic part is easy to hold and has the function of insulation protection. As pins of the plug, the metal inserts are connected with the socket for power supply. Protective measures are not available for the effective conductive part of a traditional plug. When the plug is plugged in or unplugged, the conductive inserts may produce sparks due to improper operation or water-borne pins. What's more, electric shock or short-circuit of the pins may occur when a finger touches an exposed part at the upper end of the pins due to improper operation, causing damage to users and devices.

The utility model patent (201120495928.3) discloses a power plug protector comprising a power plug body with a wire, inserts are arranged on the power plug body, and an insulating sheath is arranged on a portion of the inserts close to the power plug body. The utility model is characterized in that the inserts are arranged on the power plug body, and the insulating sheath is arranged on the portion of the inserts close to the power plug body. The existence of the insulating sheath does not affect the contact between the inserts and the socket, and more importantly, the insulating sheath is made of a material that is anti-creeping, waterproof, heat-resistant, wear-resistant, flame retardant and reusable as required. In this way, electric shock due to accidental contact between a hand with the inserts while plugging-in and unplugging the plug can be prevented due to the protective effect of the insulating sheath, avoiding damage to the human body and ensuring safe use of electricity. However, the protective sheath of the patent has obvious defects, that is, the insulating sheath is not in close contact with the plug body, the waterproof performance is poor, and the probability of leakage is high.

SUMMARY OF THE UTILITY MODEL

To address the above problems, the purpose of the utility model is to provide an insulating sheath of a plug. The insulating sheath is fit on existing common plugs of various countries in a wrapping or affixing way to protect the plugs, thereby solving the technical problem that electric shock or electrical short circuit occurs easily due to absence of protective devices for effective conductive parts of pins of the existing common plugs in various countries. Therefore, the insulating sheath can effectively solve the problem of electric shock or short circuit of pins when a finger touches an exposed part at the upper end of the pin or the problem of producing sparks due to improper operation or water borne pins.

The technical solution of the utility model is as follow:

An insulating sheath of a plug, comprising a sheet-like sheath body, a pin sheath and a pin hole, wherein the pin sheath protrudes from the sheath body, the pin hole is a through-hole allowing the pin sheath to communicate with the sheath body, and the pin hole is sheathed on pins of the plug. The insulating sheath of the structure can adhere the sheath body to an insulation part of the plug, and protect the pins of the insulating sheath at the same time, preventing short circuit by water leakage or electric leakage between pins, and also preventing electric shock caused by a finger touching the pins without affecting normal plugging-in and unplugging of the plug.

The pin sheath protrudes from a front end face of the sheath body, the pin hole is arranged in the pin sheath and communicated with a back end face of the sheath body and a free end of the pin sheath; and the front end face and the back end face are opposite sides of the sheath body respectively. The pin hole of the structure is used for wrapping the pins of the plug, so that removal and fitting of the insulating sheath can be conveniently realized.

The pin sheath protrudes from the front end face of the sheath body by a height not less than 1 mm; and the thickness of the sheath body or/and the thickness of the pin sheath is not less than 0.05 mm. The vertical setting of the structure has the function of insulation protection on the pins while effectively ensuring the connection reliability and conductivity of the plug, improving the safety and usability of the insulating sheath.

The pin sheath protrudes from the front end face of the sheath body by a height not less than 10% of the length of the pins; and the thickness of the sheath body or/and the thickness of the pin sheath is not less than 5% of the thickness of the pins. The structure is applicable to plugs of different specifications and sizes in the same proportion.

The sheath body comprises at least one pin sheath; and the number of the pin sheath on the sheath body is not more than that of the pins of the plug corresponding to the insulating sheath. Depending on different requirements of different plugs for pin sheaths, the structure can be provided with different numbers of pin sheaths to mainly protect pins that are prone to electric leakage or have great hazard of electric leakage, and effectively protect live wires and neutral wires.

The shape of the pin hole in the pin sheath corresponds to the shape of the pins of the plug. The shape and size of matching pin sheath are customized according to pins of different specifications to ensure the tightness and safety of the insulating sheath.

The pins of the plug comprise flat pins, round pins and prismatic pins, such as pins of single-phase two-pole flat plugs, single-phase two-pole flat plugs with earthing contacts and BS plugs, or pins of US plugs, pins of BS plugs, or pins of US plugs, pins of Euro plugs, SABS plugs and AS plugs. The listed pins are pins of several common plugs, but the styles of pins are not limited to the above models.

Two sides of the sheath body are a front side and a back side respectively, and the pins are sheathed on the front side of the sheath body, and a protective edge protruding from the back side of the sheath body is arranged at the edge of the back side of the sheath body. The protective edge of the structure can wrap the insulating sheath on the insulation part of the plug more tightly, thus effectively improving the tightness, and ensuring water resistance and electric shock resistance.

The protective edge arranged on the back side of the sheath body is in the form of a ring, a tooth or a claw for tightly wrapping the insulation part of the plug. The structure can be fixed according to differences in the insulation part of the plug, thereby improving the compatibility of the insulating sheath.

The protective edge protrudes from the back side of the sheath body by a height not less than 1 mm, the thickness of the protective edge is not less than 0.05 mm, and raised strips are arranged on an inside wall of the protective edge. The protruding structure can be turned up toward the insulation side of the plug, which prevents water from entering between the insulating sheath and the rubber part of the plug more effectively, affecting the safety and water resistance of the plug.

The back end face of the sheath body is closely fitted with the insulation part of the plug, and the pin sheath is tightly wrapped around roots of the pins; and the front end face and the back end face of the sheath body are opposite sides of the sheath body respectively. The structure makes the sheath body flat, so that the back end face of the sheath body and the insulation part of the plug are fitted more closely, thus effectively ensuring the water resistance of the insulating sheath.

The pins of the plug protrude from a pin mounting face of the plug, the pin sheath is sheathed on the front end face of the sheath body, and the back end face of the sheath body is closely fitted with the rubber part of the plug. In the structure, the back end face is fitted on the mounting face of the pins, and the flat face has a better fitting effect after being fitted with the back end face, thus effectively improving the water resistance.

The pins penetrate the pin hole from the back end face of the sheath body, and pass through the free end of the pin sheath to expose a metal part, and the length of the metal part is not less than 30% of the length of the pins. In the structure, the metal part of the plug is exposed, and the exposed position is just the conductive position between the plug and the socket, thereby effectively improving the water resistance without affecting the conductivity of the plug.

An adhesive layer is arranged on the back end face of the sheath body, and the adhesive layer is covered with a removable film layer to protect the adhesion thereof. The adhesive layer of the structure further improves the degree of fitting of the sheath body and improves the water resistance of the sheath body.

The adhesive layer covers the back end face of the sheath body as a film, or the adhesive layer is composed of a plurality of rings spaced apart from each other, and the thickness of the adhesive layer is not less than 0.05 mm. The adhesive layer and the layout thereof can prevent the tightness and the water resistance from being reduced when the sheath body is wrinkled.

The sheath body and the pin sheath are integrated. The integrated structure can effectively improve the water resistance of the insulating sheath, reduce the difficulty in production and production time, and reduce the production cost.

The sheath body and the pin sheath are of a combined structure, the sheath body is provided with a mounting hole for mounting the pin sheath, and a projection is arranged on a side at one end of the pin sheath for fitting with the sheath body. The combined insulating body can effectively improve the degree of freedom of the device, so that a suitable and matched sheath body and a pin sheath can be selected according to actual situations of the plug for convenient use by users.

The sheath body and the pin sheath have the features of insulation, voltage withstanding, wear resistance, rigidity, high temperature resistance and toughness.

The sheath body and the pin sheath have a withstand voltage resistance not less than 200 MΩ, a withstand voltage not lower than 5 kv, and a high temperature resistance not less than 300° C.

The sheath body is of a sheet-like structure made of PI or polyurethane, and the pin sheath is of a tubular structure made of PI or polyurethane. In conclusion, with the technical solution, the benefits of the utility model are to:

1. Solve the technical problem that electric shock or electrical short circuit occurs easily due to absence of protective devices for effective conductive parts of pins of the existing common plugs in various countries.
2. Effectively solve the problem of electric shock or short circuit of pins when a finger touches an exposed part at the upper end of the pins or the problem of producing sparks due to improper operation or water borne pins.
3. Adhere the sheath body to the insulating part of the plug, and protect the pins of the insulating sheath at the same time, preventing short circuit by water leakage or electric leakage between pins, and also preventing electric shock caused by a finger touching the pins without affecting normal plugging-in and unplugging of the plug.
4. Effectively prevent electric shock due to contact between a human body and a pin in the process of plugging-in and unplugging a GB plug, and reduce the damage caused by sparks produced by plugging-in and unplugging a common plug pin with water. Meanwhile, with the insulating sheath, the overall structure is reasonable and does not affect the compatibility with the existing GB sockets. The insulating sheath has good toughness and does not split easily, which can not only increase the service life of the pins, but can also further improve the safety performance of the plug.

Marks in the figures are described as follows: 1—sheath body, 2—pin sheath, 11—protective edge, 21—live wire pin sheath, 22—neutral wire pin sheath, 23—live wire pin sheath, 24—earth wire pin sheath, 25—neutral wire pin sheath, 3—pin hole, 31—live wire pin hole, 32—neutral wire pin hole, 33—live wire pin hole, 34—neutral wire pin hole, 35—earth wire pin hole, 4—two-pin plug, 41—live wire pin, 42—neutral wire pin, 5—three-pin plug, 51—live wire pin, 52—earth wire pin, 53—neutral wire pin.

DETAILED DESCRIPTION

The utility model will be described in detail in combination with drawings.

The utility model will be further described in detail in combination with drawings and embodiments for clear understanding of the purpose, technical solution and advantages of the utility model. It should be understood that various embodiments described herein are only used to explain the utility model rather than defining the utility model.

Embodiment 1

Figure 1:
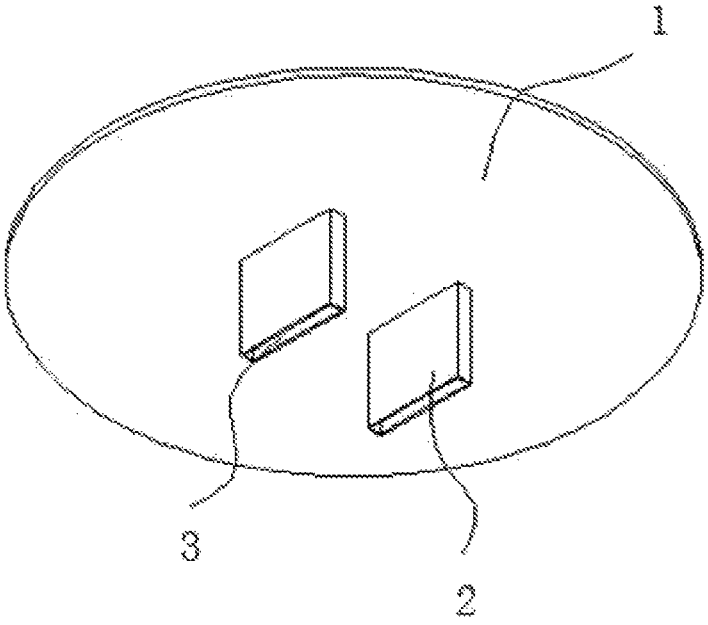
FIG. 1 is a front view of an insulating sheath without protective edge of a two-pin plug.
Figure 2:
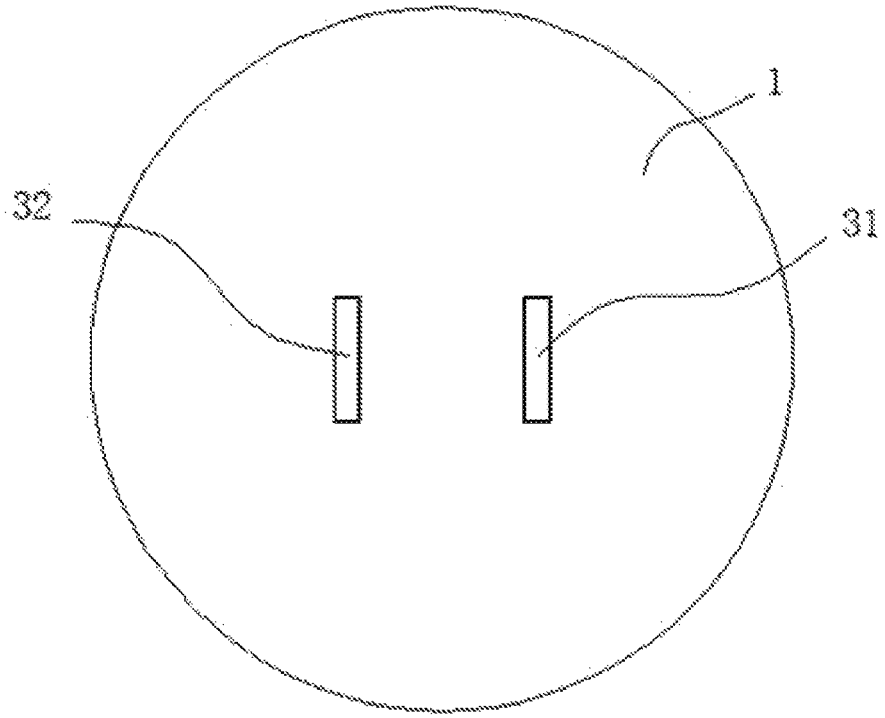
FIG. 2 is a top view of an insulating sheath without protective edge of a two-pin plug.
Figure 3:
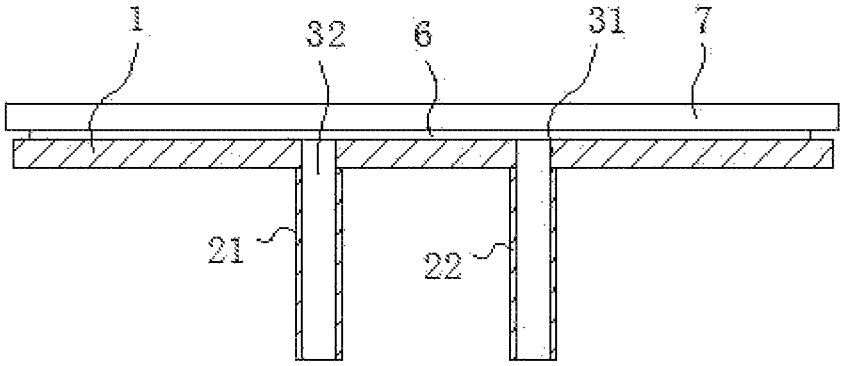
FIG. 3 is a front view of an insulating sheath without protective edge of a two-pin plug.
Figure 4:
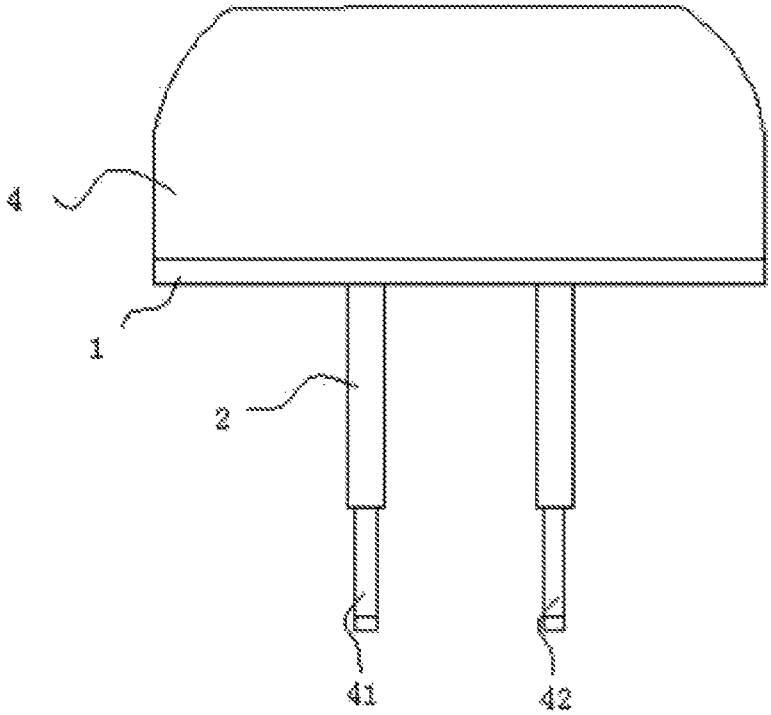
FIG. 4 is a service state diagram of an insulating sheath without protective edge of a two-pin plug.

As shown in FIGS. 1 to 4, this utility model discloses an insulating sheath for a double-pin plug 4, comprising a sheet-like sheath body 1 and a pin sheath 2. The sheet-like sheath body 1 comprises a front end surface and a back end surface. The pin sheath 2 is connected to the sheath body 1 and perpendicular to the front end surface of the sheath body 1. A pin hole 3 used for being sheathed on a pin is arranged in the middle of the pin sheath 2, passes through a joint of the pin sheath 2 and sheath body 1, and communicates with a free end of the pin sheath 2 and the back end surface of the sheath body 1 respectively. The pin sheath 2 consists of a live wire pin sheath 21 and a neutral wire pin sheath 22. The pin hole 3 arranged in the middle of the live wire pin sheath 21 and neutral wire pin sheath 22 comprises a live wire pin hole 31 and a neutral wire pin hole 32. The front end surface of the sheath body 1 is flat and level. The pin sheath 2 protrudes from the back end surface of the sheath body 1 by a height not less than 2 mm or not lower than 10% of the height of pins using the insulating sheath.

The sheath body 1 and the pin sheath 2 are made in one-piece body process at 300° C. and higher, and the high temperature resistance thereof is not lower than 300° C. The thickness of the sheath body 1 is not less than that of the pin sheath 2, and the thickness of the pin sheath 2 and the sheath body 1 is at least 0.05 mm. Alternatively, for a national standard flat pin, the thickness of the pin sheath 2 and the sheath body 1 is at least 10% of that of the pins; otherwise, the thickness of the pin sheath 2 and/or the sheath body 1 is not less than 5% of that of the pins and greater than 0.05 mm.

The sheath body 1 and the pin sheath 2 are made of an insulating, voltage withstanding, wearproof and high temperature resistant material with high rigidity. The resistance thereof is not less than 20052, and the withstand voltage is at least 5 kv. The insulating sheath can be made of PI or polyurethane materials.

The insulating sheath is arranged at roots of the pins of a national standard plug, the pins are arranged on and protrude from the pin fitting surface of the plug, and the back end surface of the sheath body 1 closely adheres to the pin fitting surface of the plug. The pins of the plug pass through the pin hole in the middle of the pin sheath 2 to allow the pin sheath 2 to be sheathed on the roots of the pins tightly. The free end of the pin extends beyond the pin sheath 2 and exposes the metal part of the pin. The exposed metal part is at least 30% of the length of the pin. When the matching insulating sheath is fit on the double-pin plug 4, the live wire pin sheath 21 is sheathed on the live wire pin 41, and the neutral wire pin sheath 22 is sheathed on the neutral wire pin 42. Alternatively, the pin sheath 2 can be sheathed on one pin only, which also provides protection against electric shock.

To increase the tightness of the sheath body and the pin fitting surface, the back end surface of the sheath body can be provided with an adhesive layer with a thickness of 0.05-0.5 mm. A film layer is covered over the adhesive layer and protects the adhesive layer from oxidation or adhesion reduction. Meanwhile, the film layer will not adhere to the adhesive layer to enable the film layer to be removed. While the insulating sheath is used, the film layer is removed, the pin sheath 2 is sheathed on the roots of the pins, and then the end surface of the sheath body is adhered to the pin fitting surface through the adhesive layer to form tight sealing. The adhesive layer can be applied to the back end surface of the sheath body evenly, or annularly to form multilayer of adhesive rings separated at a certain interval.

Embodiment 2

Figure 5:
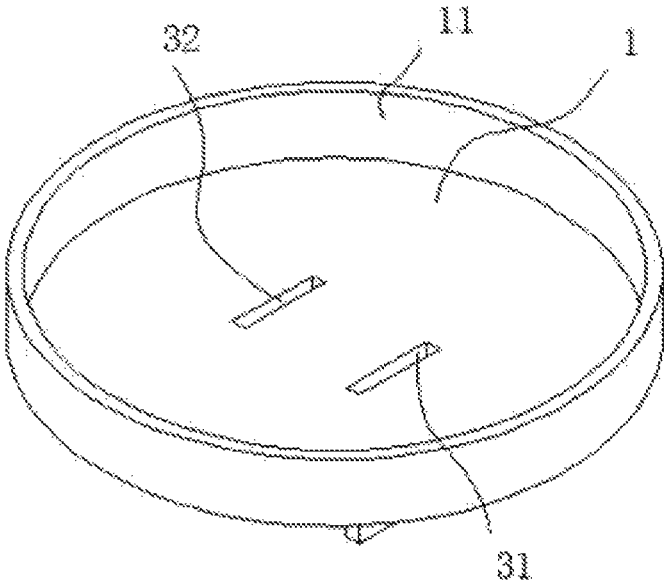
FIG. 5 is a front view of an insulating sheath with protective edge of a two-pin plug.
Figure 6:
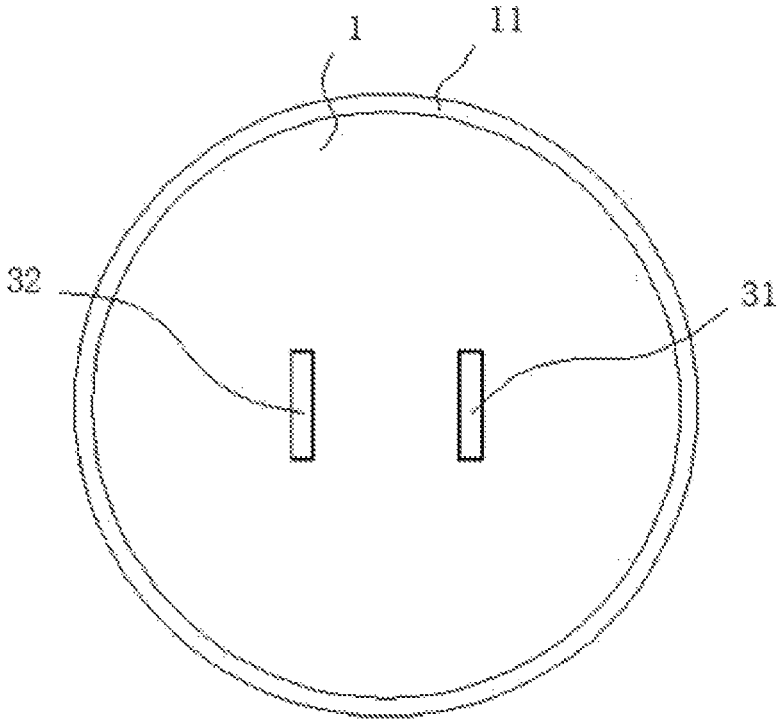
FIG. 6 is a top view of an insulating sheath with protective edge of a two-pin plug.
Figure 7:
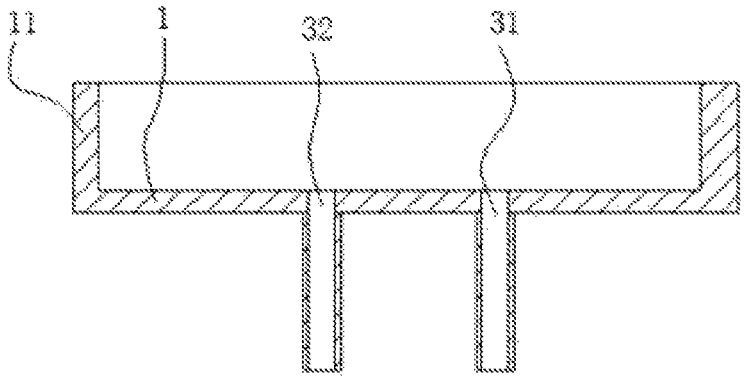
FIG. 7 is a front view of an insulating sheath with protective edge of a two-pin plug.
Figure 8:
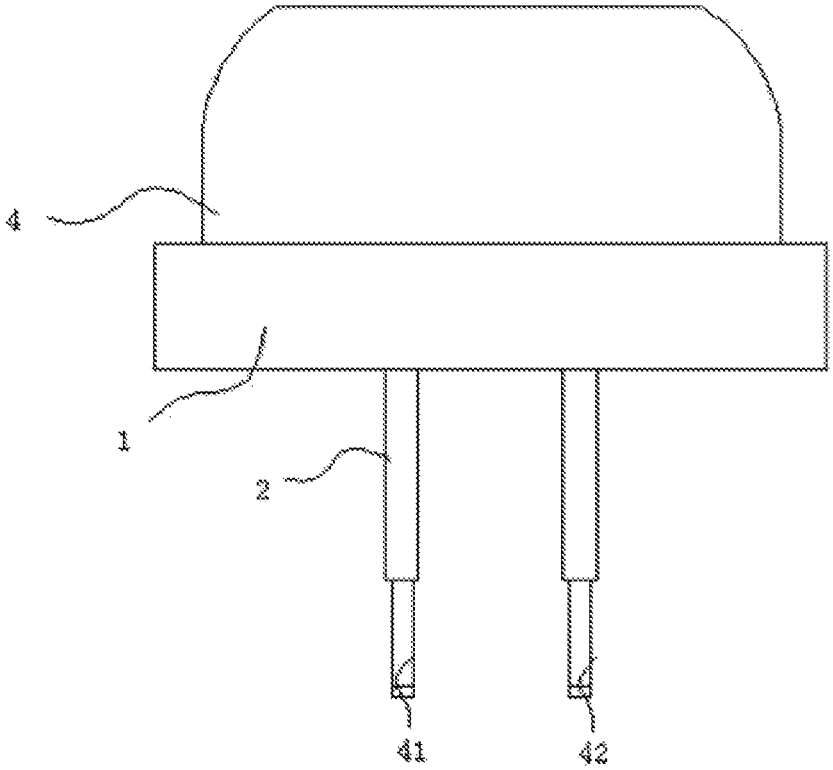
FIG. 8 is a service state diagram of an insulating sheath with protective edge of a two-pin plug.

As shown in FIGS. 5 to 8, this utility model discloses an insulating sheath with a protective edge 11 for a double-pin plug 4, comprising a sheet-like sheath body 1, a pin sheath 2 protruding from the sheath body 1 and a pin hole 3. The pins can pass through the sheath body 1 and pin sheath 2 orderly and extend beyond a free end of the pin sheath 2 to expose the metal part of the pins. At least one pin sheath 2 (usually three) is provided on the sheath body, the pin hole 3 is at the middle of the pin sheath 2, and communicates with the free end of pin sheath 2 and the back end surface of sheath body 1. The back end surface of sheath body 1 is opposite to the front end surface thereof. The pin sheath 2 protrudes from the front end surface of the sheath body for at least 3 mm, generally 4-5 mm. The pin hole 3 can be circular, square or flat, and the specific shape and position of the pin hole 3 correspond to those of a national standard plug. The sheath body 1 is provided with the protective edge 11 protruding from the back end surface. The protective edge 11 can be annular or toothed, and used for tight sheathing on sides of the plug to improve the waterproof and leakage prevention effects. The protective edge 11 protrudes from the back side of the sheath body 1 by a height more than 1-5 mm, and thickness of the protective edge 11 is generally at least 0.05 mm.

The sheath body 1 and the pin sheath 2 can be integrated by the one-piece process in embodiment 1. Additionally, the sheath body 1 and the pin sheath 2 can be of an integrated structure, that is, the pin sheath 2 is fit on the sheath body 1 detachably. Fitting holes are arranged at the position that the sheath body 1 corresponds to the pins of the plug, and used for fitting the pin sheath 2. A projection arranged on the side of a connecting end of the pin sheath 2 is fitted to the sheath body 1 by inserting the pin sheath 2 into the fitting hole from the back side of the sheath body 1, facilitating the selection of the pin sheath 2 as needed and plugs accepted in different standards around the world.

In addition, the structures of the adhesive layer and the film layer used in embodiment 1 can also be applied to the back side of the sheath body 1, in order to improve the waterproof and leakage prevention effects of the insulating sheath. The insulating sheath is made of the materials described in embodiment 1.

Embodiment 3

Figure 9:
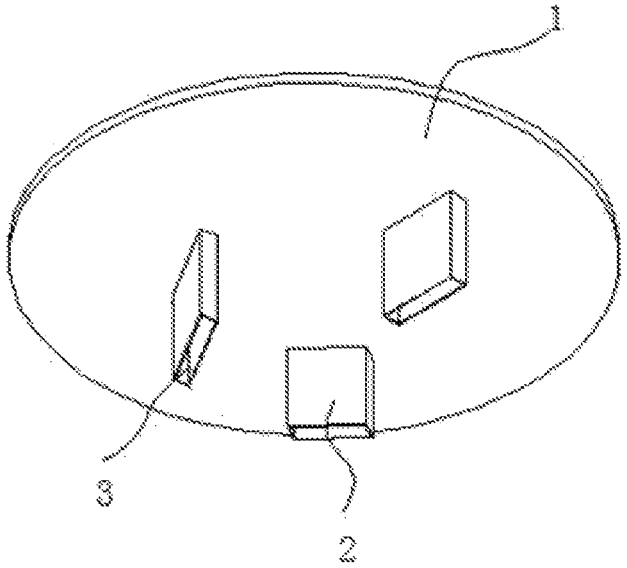
FIG. 9 is a front view of an insulating sheath without protective edge of a three-pin plug.
Figure 10:
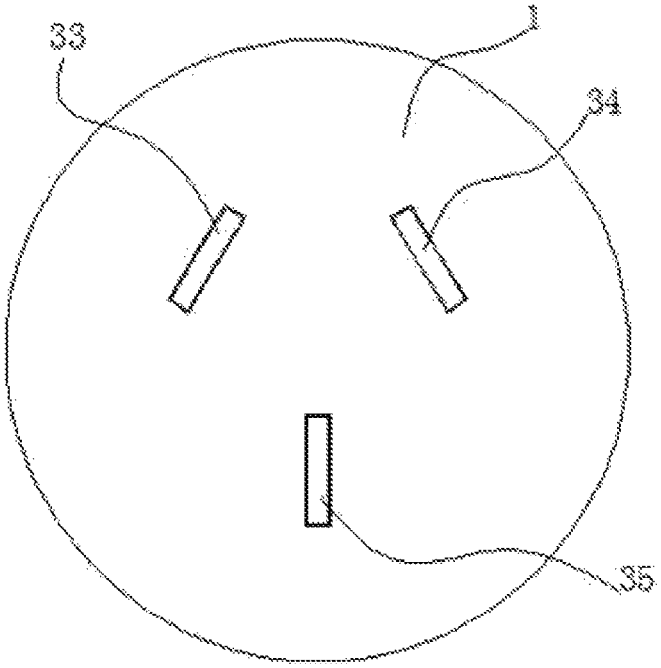
FIG. 10 is a top view of an insulating sheath without protective edge of a three-pin plug.
Figure 11:
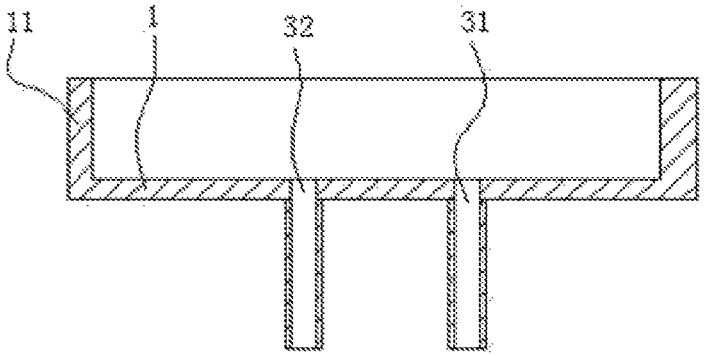
FIG. 11 is a front view of an insulating sheath without protective edge of a three-pin plug.
Figure 12:
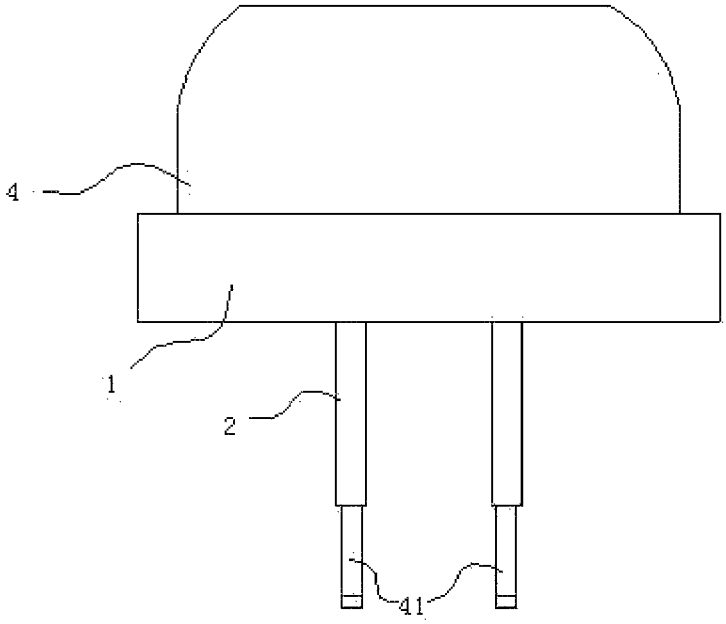
FIG. 12 is a service state diagram of an insulating sheath without protective edge of a three-pin plug.

As shown in FIGS. 9 to 12, this utility model discloses an insulating sheath for a three-pin plug, comprising a sheet-like sheath body 1, a pin sheath 2 and a pin hole 3. The sheath body is featured in a front end surface and a back end surface, and the pin sheath 2 protrudes from the front end surface of the sheath body 1. Generally, the projection height is 10%-60% (preferred 40±5%) of the length of the pins. The position of the pin sheath 2 corresponds to that of the pins of the three-pin plug. The pin sheath 2 comprises a live wire pin sheath 23, a neutral wire pin sheath 25 and an earth wire pin sheath 24. The pin hole 3 is arranged in the middle of the pin sheath 3 and communicates with a free end of the pin sheath 2 and the back end surface of the sheath body. The pin hole 3 comprises a live wire pin hole 33, a neutral wire pin hole 34 and a earth wire pin hole 35 which correspond to the live wire pin 51, the neutral wire pin 53 and the ground wire pin 52 fit on the plug respectively. The pin hole 3 can be of different shapes corresponding to the plugs recognized in different national standards, such as a plug with flat pins, a plug with round pins, a plug with square pins, BS plugs and US plugs.

The pin sheath 2 of the insulating sheath can be of various lengths to distinguish the pins of the plug. Meanwhile, the pin sheath 2 can be arranged for live wire and neutral wires only, but not for earth wires, to reduce the volume of the insulating sheath. The insulating sheath can be made of the insulating, voltage withstanding and wearproof materials with high rigidity and high toughness as mentioned in embodiment 1 (e.g. plastic materials with these features).

Figure 13:
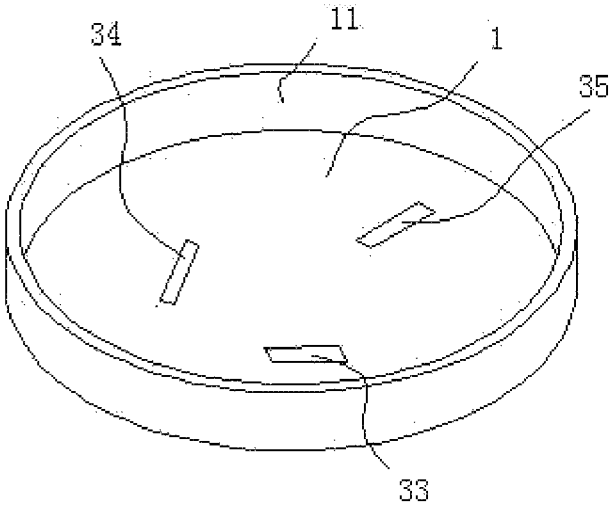
FIG. 13 is a front view of an insulating sheath with protective edge of a three-pin plug.
Figure 14:
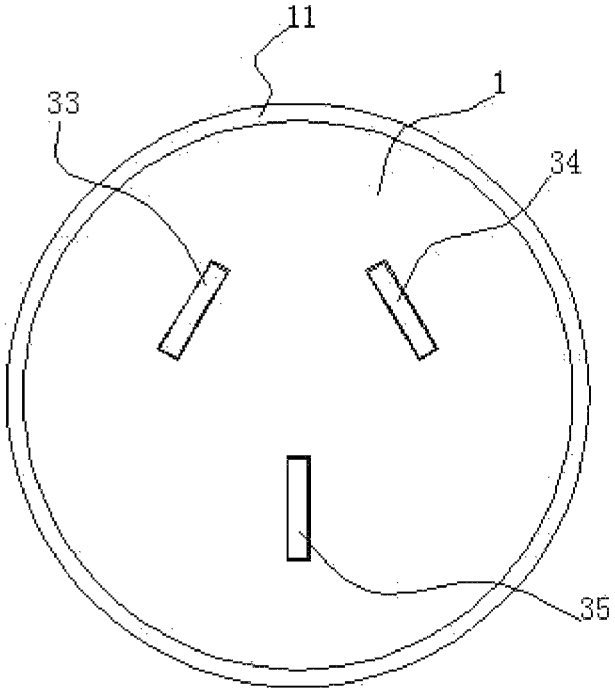
FIG. 14 is a top view of an insulating sheath with protective edge of a three-pin plug.
Figure 15:
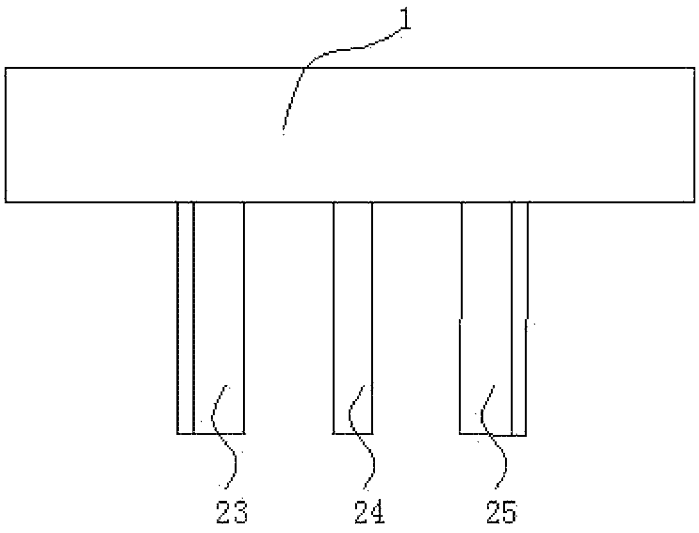
FIG. 15 is a front view of an insulating sheath with protective edge of a three-pin plug.
Figure 16:
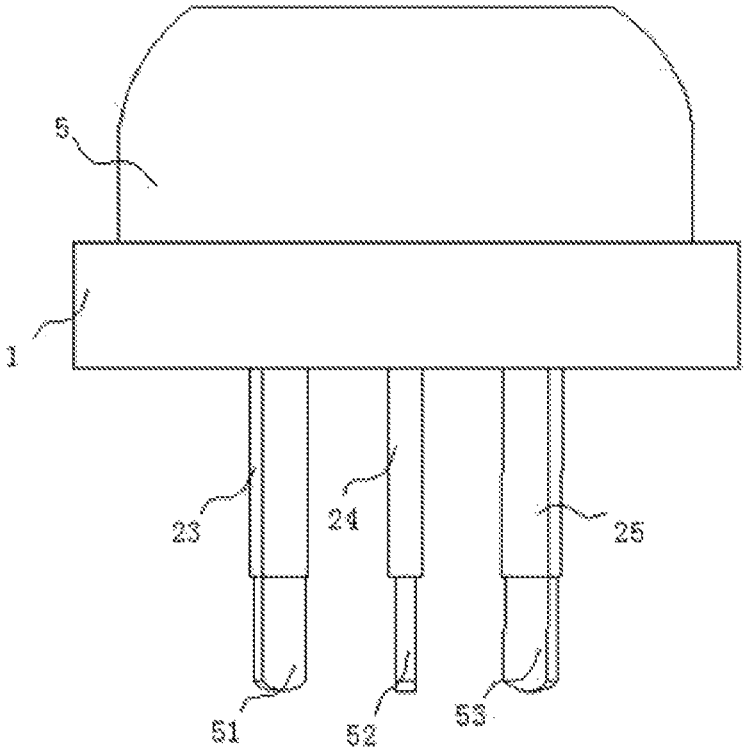
FIG. 16 is a service state diagram of an insulating sheath with protective edge of a three-pin plug.
Figure 17:
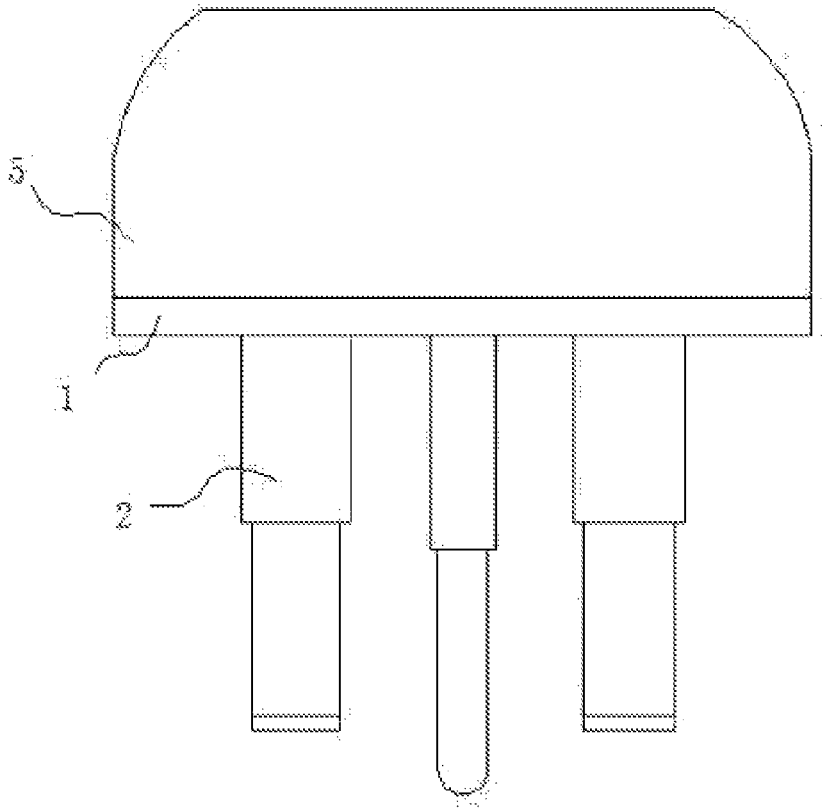
FIG. 17 is a BS plug service state diagram of an insulating sheath without protective edge of a three-pin plug.
Figure 18:
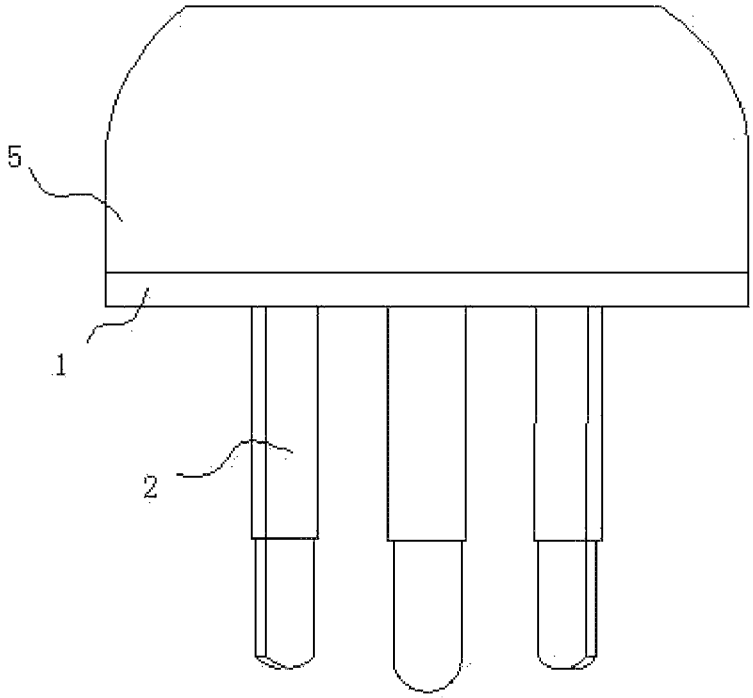
FIG. 18 is an AS plug service state diagram of an insulating sheath without protective edge of a three-pin plug.
Figure 19:
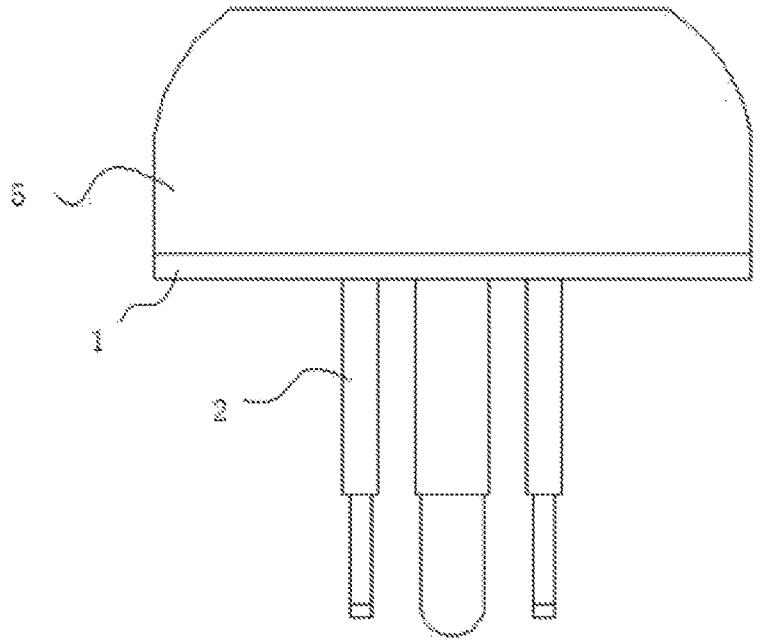
FIG. 19 is a US plug service state diagram of an insulating sheath without protective edge of a three-pin plug.
Figure 20:
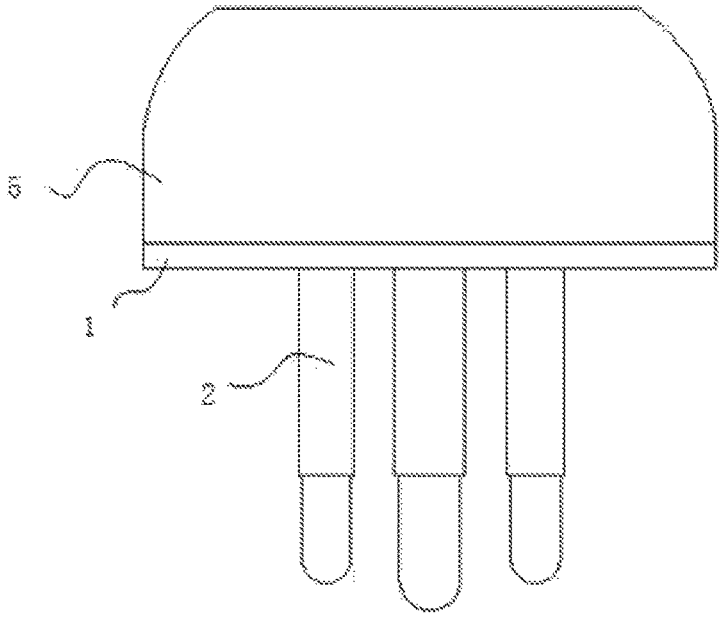
FIG. 20 is an SABS plug service state diagram of an insulating sheath without protective edge of a three-pin plug.

As shown in FIGS. 13 to 20, the insulating sheath for the three-pin plug 5 can be provided with the protective edge structure 11 described in embodiment 2. The protective edge 11 can be annular, thorny, toothed or clawed to cover the sides of the plug, in order to improve the waterproof and leakage prevention effects of the insulating sheath. The insulting sheath for the three-pin plug 5 can use the adhesive and film layer structures in embodiment 1 to improve the insulation feature effectively.

The insulating sheath is applicable to two-pin plug 4 and three-pin plug 5, as well as plugs with four or more pins. Moreover, the shape and position of the pin hole 3 and the position of the pin sheath 2 are various depending on positions of the pins of plugs, and the shape and position of the pin hole 3 correspond to the pins of the plug.

While the insulating sheath is used, the pins of the plug pass through the corresponding pin hole 3 of the insulating sheath and at least 40% of the metal part is exposed from the other end of the pin hole 3. The back end surface of the sheath body is closely against the pin fitting surface of the plug. The protective edge of the sheath body covers the side adjacent to the pin fitting surface and is fitted to the side closely with the elasticity of the edge.

The embodiments mentioned above are only preferred embodiments of the utility model and not used to limit the utility model. Any modification, equivalent replacement and improvement made within the spirit and principles of the utility model shall be incorporated in the protection scope of the utility model.

The invention claimed is:

1. An insulating sheath for an electrical plug, comprising a sheath body having a front end face and a back end face, a pin sheath protruding from the front end face of the sheath body, and a pin hole, wherein the pin hole is a through-hole extending through the pin sheath and the sheath body, wherein the pin hole is adapted to receive a pin of the electrical plug, wherein the sheath body has a protective edge disposed about a periphery of the sheath body away from the front end face of the sheath body, wherein the protective edge is in the form of a ring with a smooth edge, a toothed edge, or a clawed edge configured to engage the plug, and wherein the protective is made of an elastic, insulating material.

2. The insulating sheath of the plug according to claim 1, wherein the pin sheath protrudes from the front end face of the sheath body by a height not less than 1 mm, and a thickness of the sheath body or/and a thickness of the pin sheath is not less than 0.05 mm.

3. The insulating sheath according to claim 1, wherein the pin sheath protrudes from the front end face of the sheath body by a height of not less than 10% of a length of the pin, and a thickness of the sheath body or/and a thickness of the pin sheath is not less than 5% of thickness of the pin of the electrical plug.

4. The insulating sheath according to claim 1, wherein the protective edge protrudes from the back end face of the sheath body by a height not less than 1 mm, and a thickness of the protective edge is not less than 0.05 mm.

5. The insulating sheath according to claim 1, wherein the sheath body and the pin sheath are integrated.

6. The insulating sheath according to claim 1, wherein a number of the pin sheath on the sheath body is not more than that of the pin of the electrical plug corresponding to the insulating sheath.

7. The insulating sheath according to claim 6, wherein a shape of the pin hole in the pin sheath corresponds to a shape of the pin of the electrical plug.

8. The insulating sheath according to claim 7, wherein the pin of the electrical plug is a flat pin, a round pin, or a prismatic pin.

9. The insulating sheath according to claim 1, wherein the back end face of the sheath body is fitted with an insulation part of the plug, and the pin sheath is adapted to be wrapped around roots of the pin of the electrical plug, and the front end face and the back end face of the sheath body are on opposite sides of the sheath body.

10. The insulating sheath of the plug according to claim 9, wherein the pin of the electrical plug protrudes from a pin mounting face of the plug, the pin sheath is arranged on the front end face of the sheath body, and the back end face of the sheath body is fitted with a rubber part of the electrical plug.

11. The insulating sheath of the plug according to claim 10, wherein the pin is configured to penetrate the pin hole from the back end face of the sheath body, and to pass through the free end of the pin sheath to expose a metal part, and a length of the metal part is not less than 30% of a length of the pin.

12. The insulating sheath according to claim 9, wherein an adhesive layer is arranged on the back end face of the sheath body, and the adhesive layer is covered with a removable film.

13. The insulating sheath according to claim 12, wherein the adhesive layer is a film that covers the back end face of the sheath body or is composed of a plurality of rings spaced apart from each other, and the thickness of the adhesive layer is not less than 0.05 mm.

14. The insulating sheath according to claim 1, wherein the sheath body and the pin sheath have a withstand voltage resistance not less than 200 MΩ, a withstand voltage not lower than 5 kv, and a high temperature resistance not less than 300° C.

15. The insulating sheath of the plug according to claim 14, wherein the sheath body is of a sheet structure made of PI or polyurethane, and the pin sheath is of a tubular structure made of PI or polyurethane.

* * * * *